US005645208A

United States Patent [19]

Haytayan

[11] Patent Number: 5,645,208

[45] Date of Patent: Jul. 8, 1997

[54] PNEUMATIC FASTENING TOOL WITH SAFETY INTERLOCK

[76] Inventor: Harry M. Haytayan, 32 Indian Rock Rd., Nashua, N.H. 03063

[21] Appl. No.: 544,126

[22] Filed: Oct. 17, 1995

[51] Int. Cl.[6] ..... B25C 1/04

[52] U.S. Cl. ..... 227/8; 227/130

[58] Field of Search ..... 227/8, 130, 142, 227/120

[56] References Cited

U.S. PATENT DOCUMENTS

| | | | |
|---|---|---|---|
| 3,278,103 | 10/1966 | Juilfs et al. | 227/130 |
| 3,392,632 | 7/1968 | Volkmann | 227/130 |
| 3,434,643 | 3/1969 | Wandel | 227/130 |
| 4,196,833 | 4/1980 | Haytayan | 227/8 |
| 4,346,831 | 8/1982 | Haytayan | 227/8 |
| 4,736,879 | 4/1988 | Yamada et al. | 227/130 |
| 5,014,898 | 5/1991 | Heidrich | 227/130 |
| 5,485,946 | 1/1996 | Jankel | 227/8 |

*Primary Examiner*—Scott A. Smith
*Attorney, Agent, or Firm*—Pandiscio & Pandiscio

[57] ABSTRACT

A pneumatic fastener-applying tool is provided with a novel pneumatic safety mechanism to prevent accidental firing of the tool.

12 Claims, 6 Drawing Sheets

PNEUMATIC FASTENING TOOL WITH SAFETY INTERLOCK

BACKGROUND OF THE INVENTION

This invention relates to pneumatic tools in general and more particularly to pneumatic tools of the type shown in U.S. Pat. Nos. 4,040,554, 4,122,904, 4,227,637, 4,196,833, 4,253,598, 4,339,065, 4,346,831, 4,497,377, and 4,763,562.

These tools typically comprise a housing, a cylinder disposed in the housing, a piston slidably mounted in the cylinder, a hammer connected to the piston, selectively actuated operating means for causing the piston to reciprocate within the cylinder so as to drive the hammer from a first retracted position to a second extended position, and a nozzle section for receiving a fastener and positioning it for engagement by the hammer in order to permit the hammer to drive the fastener from the nozzle into a workpiece as the hammer is driven from its first retracted position to its second extended position. The operating means for causing the piston to reciprocate typically comprises a control valve that is operated by a manually-actuated trigger, and means responsive to operation of the control valve for selectively (a) applying a high pressure gas to one (top) side of the piston so as to urge the piston to move the hammer through its drive stroke or (b) relieving high pressure gas from the one (top) side of the piston so as to permit the piston to move the hammer through its return stroke. In addition, such tools include safety means for preventing the operating means from causing the hammer to move through its drive stroke until the safety means is operated. The safety means generally comprises a safety valve for selectively (a) applying high pressure gas to the other (bottom) side of the piston so as to urge the piston to move the hammer through its return stroke or (b) removing high pressure gas from the other (bottom) side of the piston so as to permit the piston to move the hammer through its drive stroke. The safety means also usually comprises an actuating member (commonly called a "safety rod") arranged to operate the safety valve when the actuating member is depressed, with the actuating member normally protruding through the nozzle section of the tool far enough to assure that it will be depressed by a workpiece when the nozzle section is brought up against that workpiece.

Heretofore various designs have been conceived and employed for assuring that the tool will not be fired accidentally. However, although such prior designs have improved safe use of such tools, there remains a possibility of malfunctioning of the tool.

OBJECTS AND SUMMARY OF THE INVENTION

Accordingly a primary object of this invention is to provide a pneumatic fastener driving apparatus having a novel safety interlock for preventing operation of the tool except when it is safe to use the tool.

Another object of the invention is to provide a pneumatic tool with a pneumatic interlock for the operating trigger, whereby to prevent malfunctioning of the tool.

The foregoing and other objects of the invention are addressed and achieved by providing a tool of the type described which includes a pneumatic trigger interlock for preventing operation of the tool and avoiding other problems attendant to prior tool designs. The pneumatic interlock comprises a pneumatically operated mechanical member that is movable pneumatically between a first trigger-locking position and a second trigger unlocking position. Other features and advantages are described and explained in the following detailed description of a preferred embodiment of the invention.

The following detailed description of the invention is to be considered together with the accompanying drawings wherein like members refer to like parts.

THE DRAWINGS

DESCRIPTION OF THE ILLUSTRATED EMBODIMENT

Figure 1:
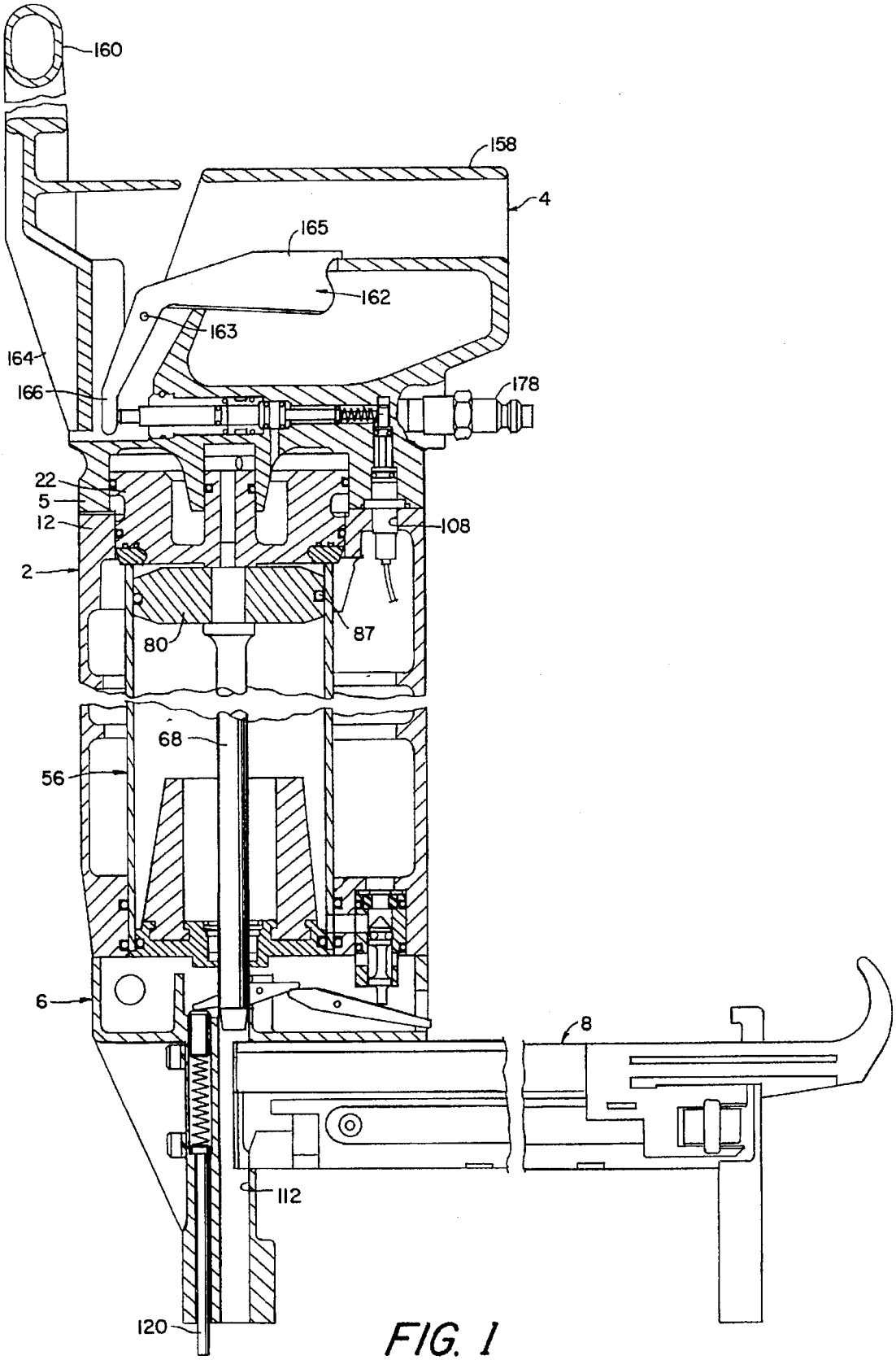
FIG. 1 is a sectional view in side elevation of a fastener driving tool made in accordance with the invention.

Referring first to FIG. 1, the illustrated fastener driving tool generally comprises an outer housing 2 which has its upper and lower ends closed off by a handle member 4 and a nozzle member 6 respectively. Nozzle member 4 includes a magazine 8 that is designed to accommodate one or more clips of fasteners (not shown) that consist of a strip of plastic sleeves each holding a fastener, e.g., as shown and described in the patents cited hereinabove. The magazine and the nail clip(s) do not form part of and hence are not critical to this invention. Handle member 4 and nozzle member 6 are removably secured to housing 2 by suitable screw fasteners (not shown).

Figure 4:
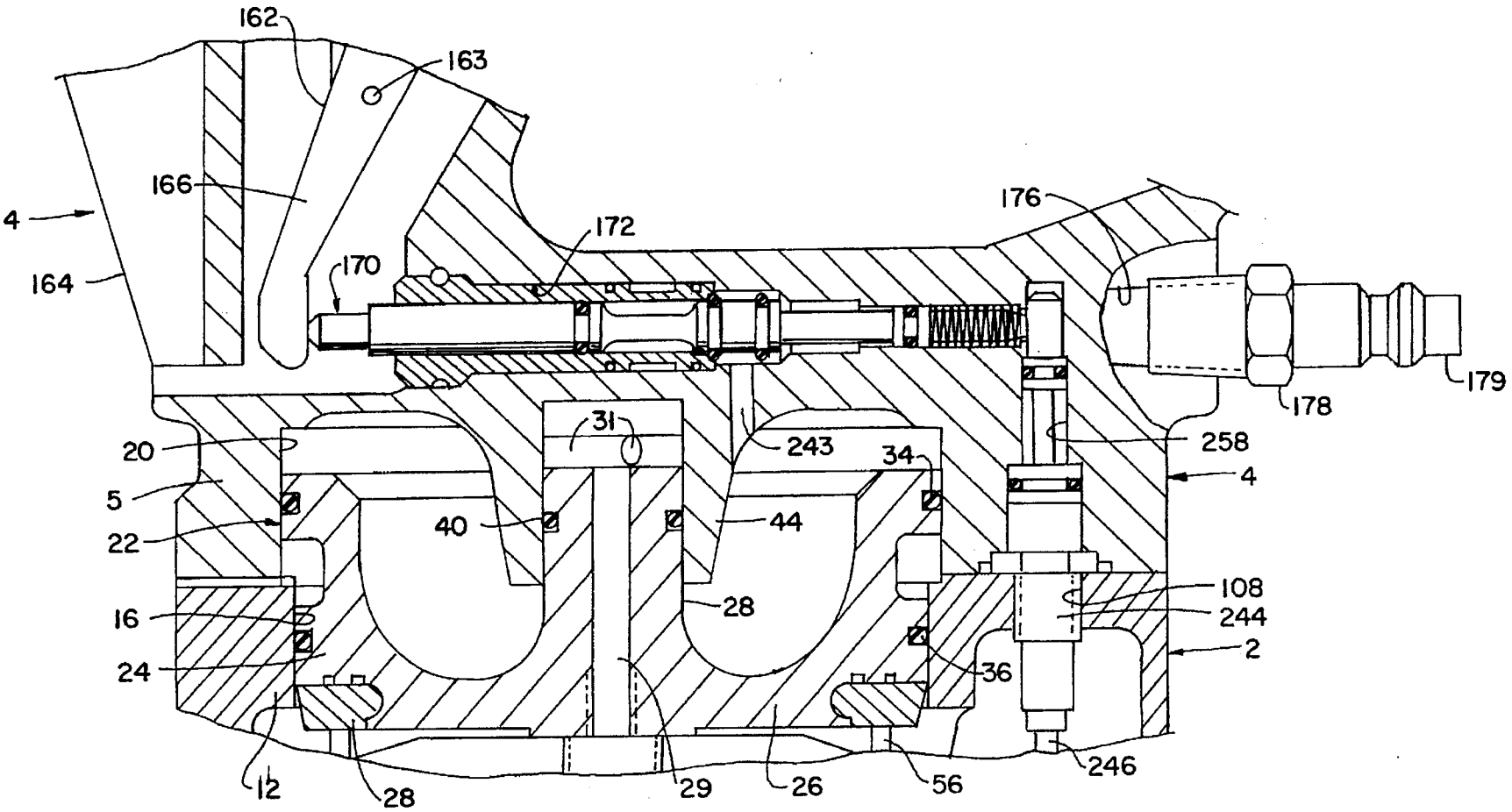
FIG. 4 is a fragmentary view on an enlarged scale of the same tool showing details of the pneumatic trigger interlock in relation to the control valve assembly.

Housing 2 is formed with an upper end wall 12 at its upper end (FIGS. 1 and 4). End wall 12 has a cylindrical opening 16 (FIG. 4) which coacts with a cylindrical cavity 20 in handle member 4 to define a poppet valve casing that slidably accommodates a poppet valve member 22. Poppet valve member 22 comprises a circumferentially extending cylindrical side wall 24, a transversely extending end wall 26 formed integral with side wall 24, and a center post 28 formed integral with end wall 26. Side wall 24 comprises two axially spaced sections having cylindrical outer surfaces of larger and smaller diameters that are provided with circumferentially-extending grooves in which O-ring seals 34 and 36 respectively are disposed. Seals 34 and 36 make a fluid-tight sliding engagement with the adjacent inner surfaces of the poppet valve casing. Center post section 28 has a central axial passageway 29 that communicates with a radial port 31 that is used to vent air from below poppet valve member 22 and above piston 80 described hereinafter.

Referring again to FIGS. 1 and 4, the upper end portion of poppet valve member 22 has a larger effective area than its lower end portion. End wall 26 (FIG. 4) of poppet valve 22 has a bottom end face formed with a recess in which is molded and captivated a resilient annular sealing member 38 that preferably is made of a suitable natural or synthetic rubber or plastic material, e.g., a silicone rubber. The bottom face of sealing member 38 is flat so that it can make a full and tight seal with the flat upper end surface of a cylinder 56 (FIGS. 1 and 3) that is described hereinafter. The outer diameter of the lower end portion of the poppet valve is sized slightly greater than the outer diameter of cylinder 56 so that a small portion of the poppet valve bottom end surface projects radially outward of the cylinder. This overlap is required in order to effectuate desired pneumatic operation of the poppet valve.

Figure 7:
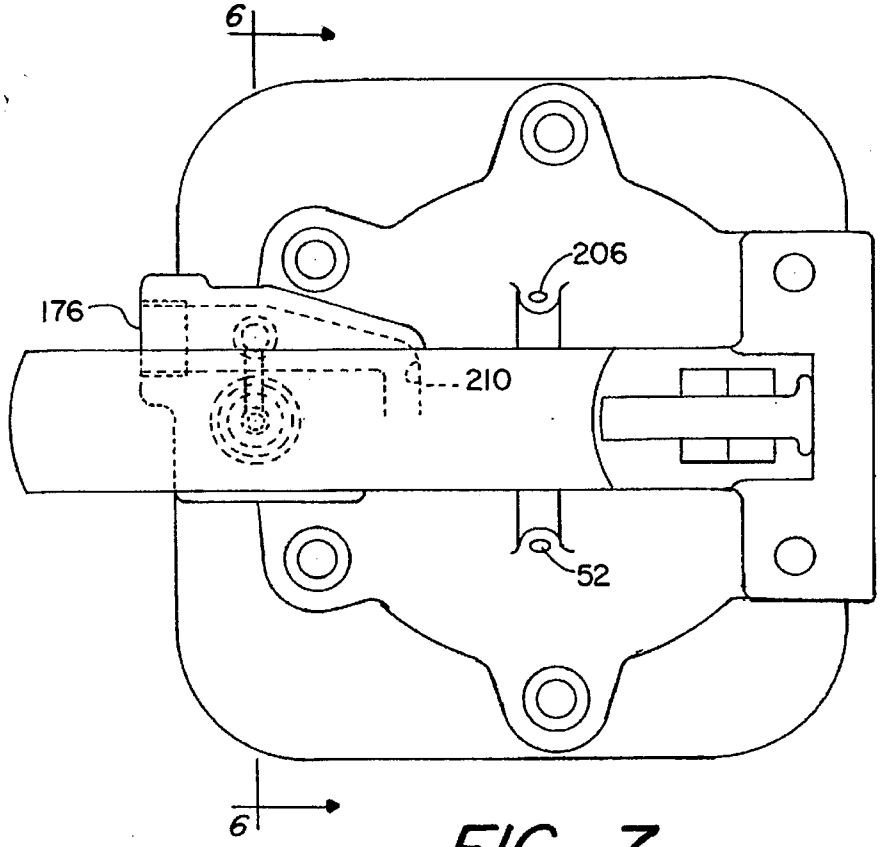
FIG. 7 is a plan view of the handle member.
Figure 6:
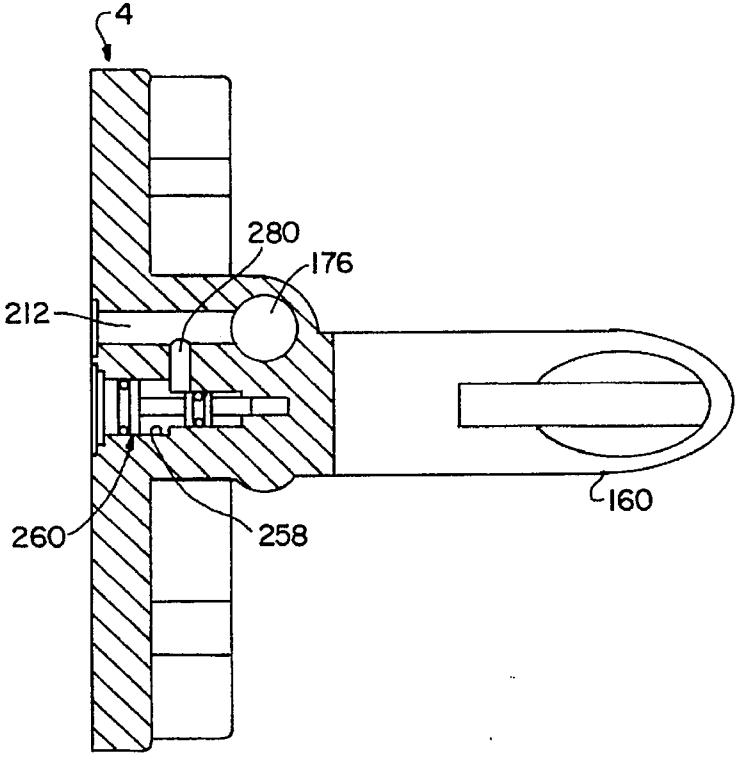
FIG. 6 is a sectional view of the handle member taken along line 6—6 of FIG. 7.

Center post section 28 of the poppet valve member has a groove to accommodate a sealing member in the form of a resilient O-ring 40 (FIG. 4) that makes an hermetic sliding seal with a surrounding internal cylindrical surface of an exhaust valve casing 44 that is formed integral with handle member 4. Valve casing 44 includes radial ports 31 and the latter communicates with the atmosphere exterior of the tool via a vent port 52 (FIG. 7) in handle member 4 that is open to the atmosphere.

Also set within housing 2 is a hollow cylinder 56. As seen best in FIG. 3, cylinder 56 is hermetically secured at its bottom end in an opening 59 in bottom end wall 58 of outer housing 2. Cylinder 56 is positioned so that, as previously noted, end sealing member 38 of poppet valve member 22 will form a tight seal with the upper end of the cylinder when the poppet valve is in its down position. Cylinder 56 is spaced from the interior surface of housing 2 so as to form a chamber 90 which serves as an air reservoir. Chamber 90 communicates with the open upper end of cylinder 56 when poppet valve 22 is moved up out of engagement with the cylinder.

Figure 2:
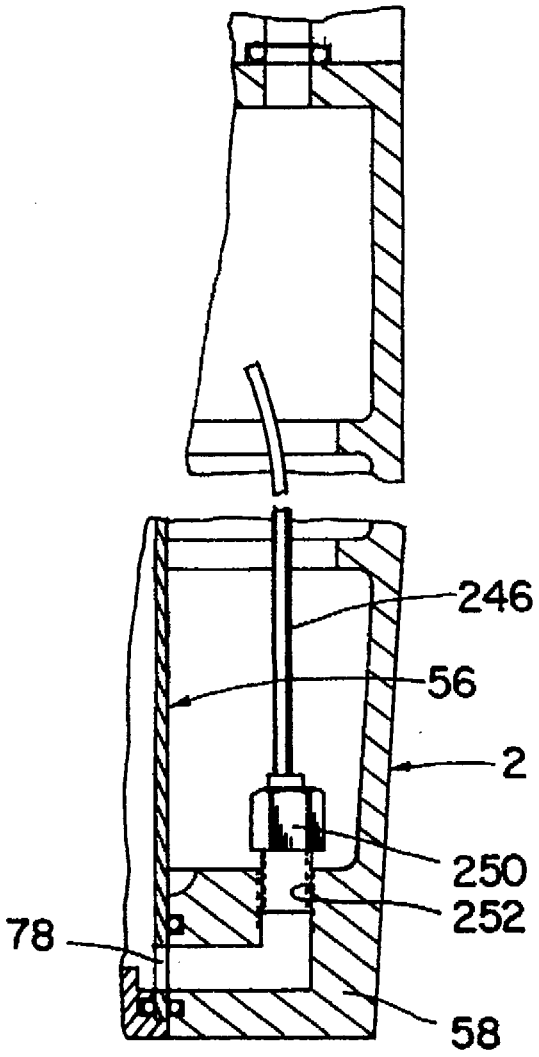
FIG. 2 is a fragmentary sectional view in side elevation of the tool of FIG. 1 taken at a different angle about the tool axis.
Figure 3:
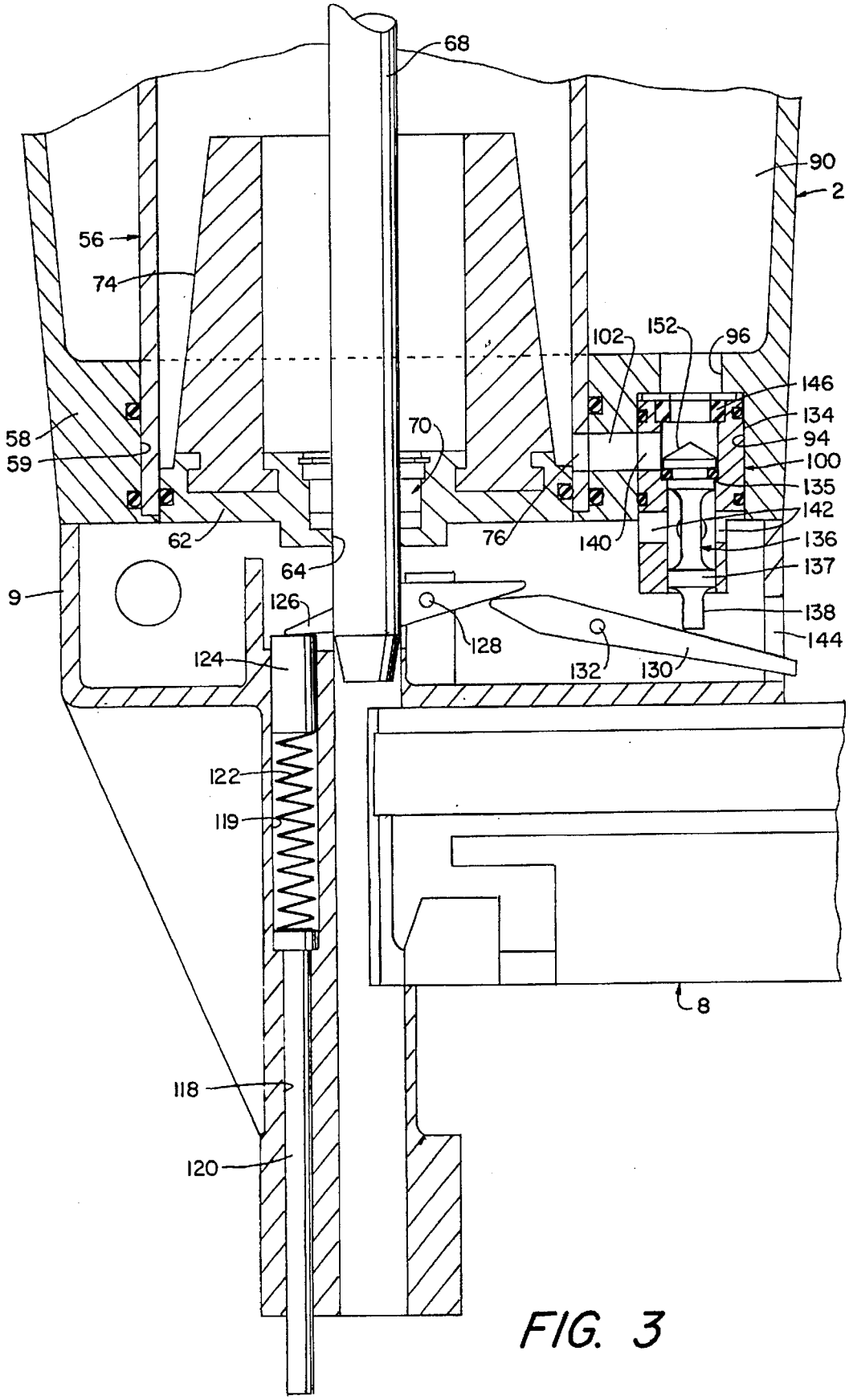
FIG. 3 is an enlarged fragmentary sectional view in side elevation of the safety mechanism of the fastener driving tool.

The bottom end of cylinder 56 is closed off by a round plug 62 (FIG. 3). A central circular bore 64 is formed in plug 62 to accommodate a hammer 68. Circular bore 64 is fitted with an annular sealing assembly 70 that surrounds and engages the hammer with just enough force to prevent leakage of fluid therebetween, while allowing the hammer to reciprocate axially. A resilient annular cushion member 74 is attached to plug 62 and extends upwardly in cylinder 56 so as to act as a bumper for a piston 80 hereinafter described as the latter undergoes a work stroke. The bottom end of cylinder 56 has at least two side ports 76 (FIG. 3) and 78 (FIG. 2) that permit ingress and egress of pressurized air as explained in greater detail hereinafter.

The upper end of hammer 68 is attached to a piston 80 (FIG. 1) which has flat upper and lower surfaces and is sized to make a close sliding fit with the interior surface of cylinder 56. Piston 80 has a peripheral groove which holds a sealing ring 87 that engages the interior surface of cylinder 56 so as to prevent leakage of fluid between the piston and the surrounding cylinder while allowing the piston to move axially within the cylinder.

Referring now to FIG. 3, the bottom end wall 58 of housing 2 has an opening 94 that extends parallel to and is spaced radially from its opening 59. Opening 94 accommodates a safety valve 100 (FIGS. 1 and 3) described hereinafter in greater detail. Opening 94 intersects a side passageway 102 (FIG. 3) in end wall 58 that communicates with side port 76 in cylinder 56. Opening 94 also leads directly to air reservoir chamber 90 via a reduced diameter orifice 96.

Referring now to FIGS. 1 and 4, the upper end wall 12 of housing 2 has an opening 108 that extends parallel to and is spaced radially from poppet valve opening 16. Opening 108 accommodates a portion of a pneumatic interlock mechanism that is described in greater detail hereinafter.

Referring now to FIGS. 1 and 3, nozzle member 6 has a first circular bore 112 that is aligned with circular bore 64 of plug 62 and hammer 68. Bore 112 is sized so that hammer 68 will make a close sliding fit therein when the hammer is extended during a fastener-driving stroke. Bore 112 also serves to accommodate a fastener (not shown) fed by magazine 8, so that when hammer 68 is driven downward the fastener in bore 112 will be engaged and driven by the hammer into a workpiece (not shown).

Still referring to FIGS. 1 and 3, nozzle member 6 also has a bore 118 in which is slidably supported a valve-actuating safety rod 120. The upper end of safety rod 120 engages a compression spring 122 that in turn engages a piston 124. Spring 122 and piston 124 are disposed in an enlarged section 119 of bore 118. The upper end of piston 124 is engaged and restrained by one end of a lever 126 which is pivotally mounted by a pivot pin 128 to a section of a hollowed-out upper end portion 9 of nozzle member 6 and has its other end in engagement with one end of a second lever 130. The latter is pivotally mounted by a second pivot pin 132 to another section of the hollowed-out upper end portion 9 of nozzle member 6 and has its other end in engagement with the rod-like end extension 138 of valve member 136 of safety valve 100.

Safety valve 100 comprises a valve casing 134 secured (by a roll pin or other suitable means, not shown) in opening 94 in the bottom end wall 58 of housing 2, and an axially-movable valve member 136 having a rod-like end extension 138. Safety valve 100 may take various forms, e.g., the forms shown in my U.S. Pat. Nos. 4,497,377, 4,346,831, 4,196,833, 4,227,637, 4,253,598, 4,763,562, and 4,339,065. Preferably, as seen best in FIG. 3, valve casing 134 is provided with a side port 140 that communicates via passageway 102 and port 76 to the interior of cylinder 56 below piston 80. Valve casing 134 also has one or more second side ports 142 that communicate with the atmosphere via a vent opening 144 in the side wall of the hollow upper hollow end section 9 of nozzle member 6. Secured in the upper end of valve casing 134 is a first (upper) annular valve seat 146 which also defines a valve port that is connected via orifice 96 in end wall 58 to reservoir chamber 90.

The interior surface of valve casing 134 is shaped so as to form a second annular (lower) valve seat 135 that is shaped and sized so as to be engaged by the enlarged head 152 of second annular valve member 136 when the latter is in its down position (FIG. 3). So long as valve head 152 is engaged tightly with its second (lower) valve seat 135, it will block passage of air between vent pods 142 and side pod 140 while permitting fluid passage between chamber 90 and the interior of cylinder 56 via orifice 96 and openings 140, 102 and 76. When valve member 136 is lifted off its second (lower) valve seat 135 and engaged with its upper valve seat 146, orifice 96 is effectively closed off, thereby preventing flow of air between side pod 140 and chamber 90 and simultaneously providing an open passageway between the volume of cylinder 56 below piston 80 and vent pods 142 via openings 76, 102 and 140.

Figure 5:
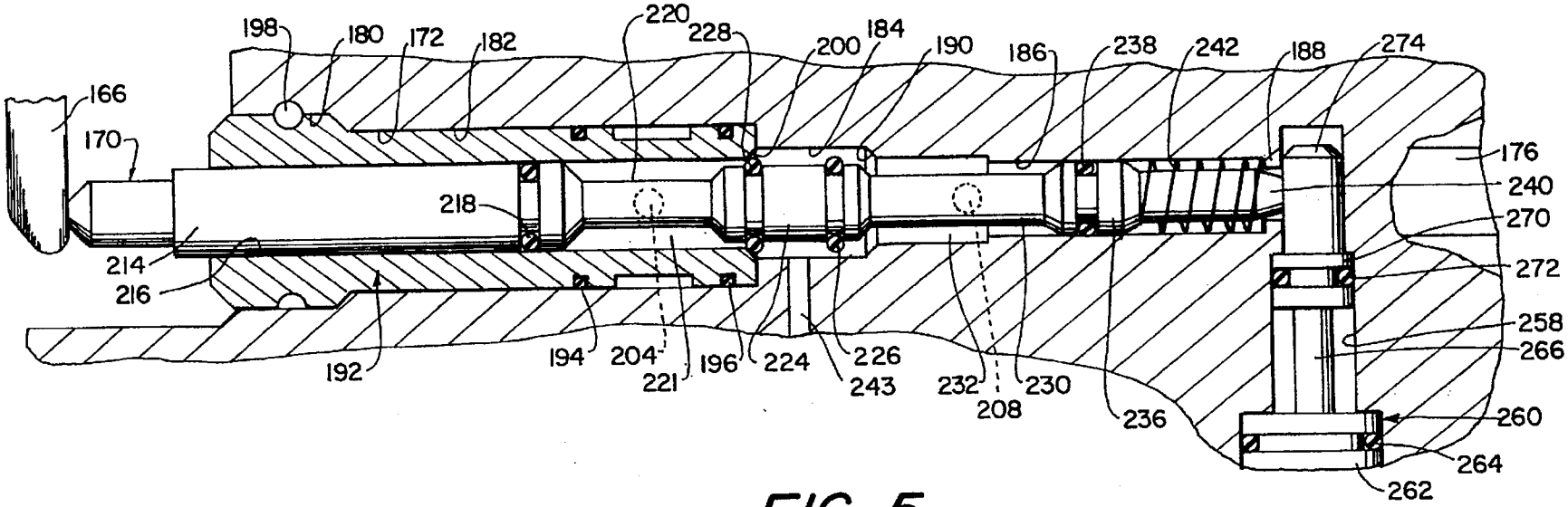
FIG. 5 is an enlarged view of the pneumatic control valve assembly shown in FIG. 4.

Turning now to FIGS. 1, 4 and 5, handle member 4 comprises a contoured primary grip portion 158, a secondary grip portion 160, a hollow bottom section 5 that has a cylindrical internal surface that defines opening 20 which functions as the upper portion of the poppet valve casing, and a passageway 243 (FIG. 4) that serves to supply high pressure air to the upper side of poppet valve member 22. A trigger member 162 is pivotally mounted at 163 to the handle member's body portion 164. Trigger member 162 is generally L-shaped, having a first end portion 165 in position to be gripped by fingers wrapped around grip portion 158, and a second opposite end portion 166 that is shaped to engage a first end of a control valve member 170 that is slidably disposed for bi-directional axial movement in a laterally-extending, multiple-diameter bore 172 that is formed in the handle member's body portion 164 (FIGS. 4 and 5). Body portion 164 of handle member 4 functions as a valve casing for control valve member 170. Handle member 4 also has a pressurized air inlet port 176 adapted to accommodate a hose fitting 178 whereby it may be connected by a hose line 179 to an external regulated source of pressurized air, e.g., a 125 psi air supply.

Referring now to FIG. 5, bore 172 has a first enlarged diameter end section 180, a first intermediate diameter section 182, a second intermediate diameter section 184, and a second opposite end section 186 that has a smaller diameter than section 184 and terminates in an internal annular end shoulder 188 that defines an end opening. Section 184 of bore 177 is characterized by an end shoulder 190 that functions as a first seat for control valve member 170. Intersecting bore section 184 is the passageway 243 that leads into the poppet valve casing. Disposed in bore sections 180 and 182 is a bushing 192 that is provided with O-ring seals 194 and 196 as shown to prevent leakage of fluid from bore 172. A roll pin 198 coacts with body portion 164 and a hole in handle member 4 to lock bushing 192 in place. The inner end surface of bushing 192 is milled to provide a shoulder 200 that serves as a second seat for valve member 170.

Bushing 192 is provided with a radial side port 204 that is aligned and communicates with an external vent port 206 (FIG. 7) in body portion 164. Vent port 206 connects side port 204 to the atmosphere outside of the tool. Section 186 of bore 172 is provided with a radial side port 208 that is connected by a passageway 210 (FIG. 7) in handle member 4 to air inlet port 176. Port 176 also is connected to a passageway 212 that leads through a hole (not shown) in upper end wall 12 into reservoir chamber 90.

Control valve member 170 has multiple diameters. It has a first diameter section 214 that is sized to make a close sliding engagement with the internal cylindrical surface 216 of bushing 192. An O-ring sealing member 218 on the valve section 214 serves to prevent leakage of fluid out from between it and bushing 192. Valve member 170 also has a second reduced diameter section 220 that defines a moving valve chamber 221 that communicates with port 204, and a third diameter section 224 that is provided with axially-spaced circumferential grooves in which are seated O-ring seals 226 and 228. Section 224 serves as a piston. Seals 226 and 228 are sized to engage valve seats 190 and 200 respectively according to reciprocatory movement of the valve member. Seal 226 serves as a valve head to prevent flow of fluid past valve seat 190 while seal 228 serves as a valve head for valve seat 200. Valve member 170 has another reduced diameter section 230 that defines a moving valve chamber 232 that communicates with high pressure air port 208. Valve member 170 also has an enlarged section 236 with a circumferential groove in which is seated another O-ring seal 238. Section 236 also acts as a piston, but its diameter and hence its effective end surface area is substantially less than that of piston 224. Seal 238 serves to prevent escape of fluid from between bore 172 and valve member section 236. The end of valve member 172 adjacent section 236 has a reduced diameter section 240 that is surrounded by a compression spring 242. One end of spring 242 engages shoulder 188 of bore 172, while its opposite end is engaged by piston section 236. Spring 242 exerts a force on valve member 170 in the direction of trigger 162.

Referring now to FIGS. 1, 2 and 4–6, mounted within opening 108 in the upper end wall 12 of housing 2 is a hose fitting 244 that forms part of the pneumatic interlock assembly mentioned hereinabove. One end of a flexible tube or hose 246 is coupled to hose fitting 244. The other end of hose 246 is connected to a fitting 250 that is mounted in an opening 252 in bottom end wall 58 of housing 2. Opening 252 communicates with the interior of cylinder 56 via the port 78. The latter port is in the same plane as but is spaced circumferentially from port 76.

As seen in FIGS. 4 and 5, handle member 4 has a multi-diameter bore 258 that extends at a right angle to bore 172 and parallel but eccentric to the axes of poppet valve 22, hammer 68 and cylinder 56. Bore 258 is aligned axially with hose fitting 244. Mounted within bore 258 for reciprocal axial movement is a pneumatically-operated locking member 260. The latter has multiple sections of different diameters, including a relatively large diameter piston section 262 that is fitted with an O-ring 264 to provide a close sliding, leak-proof fit with a first relatively large diameter section of bore 258, a relatively small diameter connecting section 266, a smaller diameter piston section 270 fitted with an O-ring 272 to provide a close sliding, leak-proof fit with a smaller diameter section of bore 258, and an end section 274 that has a smaller diameter than piston section 270 and makes a close sliding fit in a still smaller diameter section of bore 258. Bore 258 intersects bore 172 so that the upper end section 274 of locking member can intercept and block movement of control valve member 170 by trigger 162. Hose or tube 246 provides for transmittal of air from the interior of cylinder 56 below piston 80 to the large piston section 262 of locking member 260. A passageway 280 (FIG. 6) in handle member 4 leads from passageway 212 to bore 258 in between piston sections 262 and 270, thereby subjecting those piston sections to pressurized air introduced at inlet 176.

Operation of the tool will now be described. Assuming that safety rod 120 is extended as shown in FIG. 1 and inlet hose fitting 178 is connected to a suitable source of high pressure air (e.g., air at 125 to 150 psi), the high pressure air will pass (1) through passageway 210 and port 208 (FIG. 5) into control valve chamber 232, (2) through passageway 280 into bore 258, and (3) through passageway 212 into reservoir chamber 90. The high pressure air in chamber 232 will urge control valve member 170 toward trigger 162, and chamber 221 is vented to the atmosphere via ports 204 and 206. The high pressure air in chamber 90 will flow through safety valve 100 into cylinder 56 below piston 80, thereby urging the piston to assume its raised position (FIG. 1). The high pressure air in chamber 90 forces safety valve member 136 to its "down" position (FIGS. 1 and 3). The high pressure air in chamber 232 passes via passageway 243 into the poppet valve casing so as to provide a downward pressure on poppet valve member 22, and air is vented from between the piston 80 and poppet valve member 22 via vent passageways 29, 31 and 52.

The high pressure air in the lower end of cylinder 56 also passes via port 78, tube 272 and hose fitting 244 into bore 258 to the underside of piston section 262 of lock member 206. The resulting differential in the air pressure applied to piston sections 262 and 270 of locking member 260 forces the latter to assume the raised position shown in FIG. 5, wherein its upper end section 274 blocks movement of valve member 170 by operation of trigger 162. In its raised position (FIG. 5) locking member 260 prevents control valve member 170 from being moved by trigger member 162, with the result that valve member 170 is locked in the position shown in FIG. 5. That locking position assures that air pressure keeps the poppet valve in its down position (FIG. 1).

Under these conditions the hammer 68 is in raised position so that a fastener may be fed from the magazine 8 into the bore 112 immediately below the hammer. Also, since safety rod 120 is not engaged with a work surface, it is held in extended position by action of safety valve stem 138 acting through levers 130 and 126, piston 124 and spring 122. With safety valve 100 in the down position shown in FIG. 3, air is prevented from being vented out from cylinder 56 via port 76 and hence the piston remains in raised position.

If the operator tries to operate the trigger 162 while the safety rod 120 is still in its extended position, movement of the trigger will be prevented as a consequence of locking member 260 intercepting and blocking trigger-forced rightward movement (as seen in FIG. 4) of valve member 170 in bore 164. However, if nozzle member 6 is pressed against a workpiece with enough force to push safety rod 120 upward in bore 118, the upward movement of safety rod 120 will cause pivoting movement of levers 126 and 130, with the result that lever 130 is pivoted counterclockwise to force valve member 136 upwardly in safety valve casing 134. This upward movement of safety valve member 136 is sufficient to move its valve head 152 off of its lower valve seat and engage its upper valve seat 146, thereby blocking flow of air between reservoir chamber 90 and valve casing 134 via orifice 96 and allowing air to be vented from the interior of cylinder 56 via opening 76, passageway 102, port 140, vent ports 142 and opening 144. When this occurs, high pressure air is vented from below piston 80, thereby establishing a condition that permits rapid acceleration of piston 80 and hammer 68 when subsequently the poppet valve is opened. At the same time, the differential air pressure acting to keep locking member 260 in locking position is relieved as a result of the air in cylinder 56 below drive piston 80 being vented to the atmosphere via safety valve 100, Instead, the high pressure air introduced into bore 258 via passageway 280 acts on piston section 262 of locking member 260 to force the latter downward (as seen in FIGS. 4 and 5), thereby freeing valve member 170 for movement by trigger 152.

If thereafter trigger 162 is depressed so as to pivot it counterclockwise (as viewed in FIG. 1), the lower end section 166 of the trigger will force valve member 170 to the right over the upper end of locking member 260, thereby causing O-ring valve element 226 to engage valve seat 190 and moving O-ring valve member 228 out from engagement with valve seat 200. As a result, the flow of high pressure air from port 208 to passageway 243 is blocked off and simultaneously, high pressure air above the poppet valve is vented to the atmosphere via passageway 243, port 204 and vent opening 206. As a result poppet valve 22 immediately moves upward, thereby blocking exhaust port(s) 31 and allowing high pressure air to enter the upper end of the cylinder from chamber 90 and forcing piston 80 in a downward direction so as to cause the hammer 68 to engage a fastener in bore 112 and drive that fastener out of the bore into a workpiece.

It is to be noted that safety valve 100 is designed so that its valve head 152 is larger than its piston section 137 (the latter acts also to guide valve member 136 in casing 134), with the result that high pressure air in chamber 90 always urges control valve member 136 to the down position shown in FIG. 3. Consequently if, after the tool has been fired to drive a fastener as described above, the tool is moved away from the work surface and the trigger is released, air pressure in chamber 90 will force control valve member 136 to move down and cause levers 130 and 126 to re-extend safety rod 120. Also air pressure will urge control valve member 170 to return to its original position against valve seat 200 and thereby passageway 243 will be sealed off from vent port 204 and passageway 243 will be reconnected to port 208, whereby high pressure air will again flow via passageway 243 to the back side of poppet valve 22 so as to force the latter back down into sealing engagement with the top end of the cylinder. The return of safety valve member 136 to the down position shown in FIG. 1 will cause high pressure air to flow from chamber 90 into the bottom end of cylinder 56 so as to raise piston 80. The same high pressure air will cause locking member 260 to be moved upwards in bore 258 back into blocking relation with control valve member 162.

The spacing and diameter of piston sections 224 and 238 of the control valve member are sufficient to assure that the control valve member will automatically return to trigger-blocking position once the safety rod is no longer retracted. As a result, the spring 232 is not required to be able to force the control valve member back to the trigger-blocking position shown in FIGS. 1, 4, and 5; instead it suffices if the spring is designed so that it is able to exert only a light force that is just sufficient to overcome the friction force of the O-rings 278 and 210. In other words, the relative diameters of the piston sections 226 and 214 are such that the differential air pressure acting on the piston section 214 causes the valve member to close on the valve seat 200 without need for reliance on the spring 232.

An additional novel feature of the invention is the fact that the trigger lock member 260 is operated purely pneumatically without the need for any return spring to assure that it will be moved to its "up" position (i.e., the position wherein it locks control valve 170 against operation by trigger member 156). Instead the invention provides that lock member 200 will be moved to its "up" position by a purely pneumatic force after the tool has been used to drive a fastener into a workpiece. However, if desired, a spring could be used to augment movement of locking member 260 into or out of its trigger-locking position.

The spring-loaded arrangement for the safety rod has two advantages. The spring 119 allows some lost motion of safety rod 120. Essentially the spring absorbs mechanical shock, thus reducing the likelihood that a sudden impact on the safety rod will result in shearing off the pivot pins 128 and 132 that mount levers 126 and 130 to the nozzle member. A second advantage is that it facilitates use of the tool with narrow groove decking. With this design the safety rod does not need to be flush with the bottom end surface of the nozzle section in order to operate safety valve 100.

Other advantages of the invention will be obvious to persons skilled in the art.

What is claimed is:

1. A pneumatic tool comprising:

a hollow housing having oppositely disposed upper and lower ends;

first and second end means closing off said upper and lower ends respectively of said housing;

a hollow cylinder mounted in said housing, said cylinder having upper and lower ends;

a piston slidably mounted in said cylinder;

a hammer connected to said piston and slidably positioned in a bore in said second end means;

an air reservoir within said housing exterior of said cylinder;

an inlet for connecting said tool to a source of high pressure air;

a passageway connecting said inlet to said air reservoir;

a safety valve mounted to said housing for alternately (1) transmitting high pressure air from said air reservoir to said lower end of said cylinder below said piston, and (2) exhausting high pressure air from said lower end of said cylinder below said piston;

a rod movably carried by said second end means for operating said safety valve;

a poppet valve within said housing for rapidly opening or closing said upper end of said cylinder above said piston, in order that high pressure air supplied via said inlet may or may not be admitted to the upper end of said cylinder above said piston;

a control valve disposed in said first end means above said poppet valve, said control valve comprising a movable control valve member movable between a first position in which said control valve member allows transmittal of high pressure air from said inlet to said poppet valve and a second position in which said control valve member blocks transmittal of high pressure air to said poppet member and instead allows high pressure air to be exhausted from said poppet valve;

manually-operated means for moving said control valve member so that said control valve will alternately (1) transmit high pressure air from said inlet to said poppet valve so as to cause said poppet valve to close off said end of said cylinder above said piston, or (2) exhaust said high pressure air from said poppet valve so as to cause said poppet valve to open up said upper end of said cylinder above said piston, in order that said piston may be driven from said upper end of said cylinder to said lower end of said cylinder when (a) said rod-operated safety valve has exhausted high pressure air from said lower end of said cylinder below said piston and (b) said control valve has exhausted said high pressure air from said poppet valve so as to cause said poppet valve to open up said upper end of said cylinder above said piston to the high pressure air supplied via said air inlet; and pneumatically-operated means for preventing operation of said control valve by said trigger, said pneumatically-operated means comprising a pneumatically operated mechanical member and means supporting said pneumatically operated mechanical member for reciprocal movement into and out of intercepting and blocking relation with said control valve member.

2. A pneumatic tool according to claim 1 wherein operation of said pneumatically-operated means is controlled by operation of said safety valve.

3. A pneumatic tool according to claim 2 wherein said control valve member is pneumatically-biased in a direction to oppose movement thereof by manually-operated means.

4. A pneumatic tool according to claim 3 wherein said first end means comprises a handle section for holding said tool, and further wherein said manually-operated means comprises a trigger member in position to cause said control valve member to move in a first direction when said trigger member is moved in a selected direction.

5. A pneumatic tool according to claim 4 wherein said control valve member comprises first and second piston sections with said first piston section having a larger diameter than said second piston section, and further including means for applying pressurized air to said first and second piston sections, said first and second piston sections being disposed so that application of high pressure air from said inlet will force said control valve member to a first position whereat said control valve member will apply pressurized air to said poppet valve so as to keep that poppet valve in a closed position.

6. A pneumatic tool comprising:

a hollow housing having oppositely disposed upper and lower ends and handle means including a trigger for use in holding and operating said tool;

a hollow cylinder mounted in said housing, said cylinder having upper and lower ends;

a piston having upper and lower sides slidably mounted in said cylinder;

a hammer connected to said lower side of said piston;

lower end means connected to said housing for slidably supporting said hammer;

an air reservoir within said housing exterior of said cylinder;

an inlet for connecting said tool to a regulated source of high pressure air;

a passageway connecting said inlet to said reservoir;

a safety valve mounted to said housing for alternately (1) transmitting high pressure air from said air reservoir to said cylinder below said lower side of said piston, and (2) exhausting high pressure air from said cylinder below said lower side of said piston;

a rod movably carried by said lower end means for operating said safety valve;

a poppet valve for rapidly opening or closing said upper end of said cylinder above said upper side of said piston in order that high pressure air from said reservoir may or may not be admitted to the upper end of said cylinder above said piston;

a control valve disposed for operation by said trigger for alternately (1) transmitting high pressure air from said inlet to said poppet valve so as to cause said poppet valve to close off said end of said cylinder above upper side of said piston, or (2) exhausting said high pressure air from said poppet valve so as to cause said poppet valve to open up said upper end of said cylinder above said upper side of said piston, in order that said piston may be driven from said upper end of said cylinder to said lower end of said cylinder when (a) said rod-operated safety valve has exhausted high pressure air from said lower end of said cylinder below said piston and (b) said control valve has exhausted said high pressure air from said poppet valve so as to cause said poppet valve to open up said upper end of said cylinder above said piston to the high pressure air of said air reservoir;

said control valve member comprising a valve member movable between a first position in which said valve member allows transmittal of high pressure air from said inlet to said poppet valve and a second position in which said valve member blocks transmittal of high pressure air to said poppet member and instead allows high pressure air to be exhausted from said poppet valve; and pneumatically-operated means for preventing movement of said control valve by said trigger from its said first position to its said second position.

7. A pneumatic tool according to claim 6 wherein said pneumatically-operated locking means comprises a pneumatically-operated locking member mounted for reciprocal axial movement into and out of intercepting relation with said control valve member, and means for subjecting said pneumatically-operated member and the bottom side of said piston to the same air pressure simultaneously.

8. A pneumatic tool according to claim 7 wherein said pneumatically-operated means is carried by said handle means.

9. A pneumatic tool according to claim 7 wherein said handle means comprises a section that closes off said upper end of said hollow housing, and further wherein said handle section forms part of the valve casing foraid poppet valve and also a casing for said pneumatically-operated locking member.

10. A pneumatic tool according to claim 7 wherein said handle means comprises an air inlet adapted for connection to an exterior source of pressurized air, and further wherein said handle means includes passageways for transmitting high pressure air to said poppet valve and, said cylinder and said pneumatically-operated means.

11. A pneumatic tool according to claim 7 having lost motion means for causing operation of said safety valve by movement of said rod.

12. A pneumatic tool according to claim 11 wherein said lost motion means comprises a spring engaged with said rod, a piston engaged by said spring, and lever means mechanically coupling said piston to said safety valve whereby movement of said rod causes said safety valve to change states.

* * * * *

UNITED STATES PATENT AND TRADEMARK OFFICE

CERTIFICATE OF CORRECTION

PATENT NO. : 5,645,208
DATED : July 8, 1997
INVENTOR(S) : Harry M. Haytayan

It is certified that error appears in the above-indentified patent and that said Letters Patent is hereby corrected as shown below:

Claim 6, column 10, line 35, the word "said" should be inserted before the word -- upper --; and Claim 9, column 11, line 7, delete the word "foraid" and insert the words -- for said --.

Signed and Sealed this

Seventh Day of October, 1997

*Attest:*

*Attesting Officer*

Bruce Lehman

BRUCE LEHMAN

*Commissioner of Patents and Trademarks*